US011459716B2

(12) United States Patent
Zhang et al.

(10) Patent No.: US 11,459,716 B2
(45) Date of Patent: Oct. 4, 2022

(54) ELECTROHYDRAULIC ACTUATOR SYSTEM FOR SNOW-REMOVAL COMPONENTS

(71) Applicants: Bosch Rexroth Canada, Burlington (CA); Robert Bosch GmbH, Stuttgart (DE)

(72) Inventors: Jun Zhang, Burlington (CA); Boyd de Waard, RR2 Port Colborne (CA); Tim Giesbrecht, Wainfleet (CA)

(73) Assignees: Bosch Rexroth Canada Corporation, Ontario (CA); Robert Bosch GmbH, Stuttgart (DE)

( * ) Notice: Subject to any disclaimer, the term of this patent is extended or adjusted under 35 U.S.C. 154(b) by 797 days.

(21) Appl. No.: 16/426,465

(22) Filed: May 30, 2019

(65) Prior Publication Data

US 2020/0199836 A1 Jun. 25, 2020

Related U.S. Application Data

(60) Provisional application No. 62/782,988, filed on Dec. 20, 2018.

(51) Int. Cl.
*E01H 5/06* (2006.01)
*E01H 10/00* (2006.01)

(52) U.S. Cl.
CPC ..... *E01H 5/061* (2013.01); *E01H 10/007* (2013.01)

(58) Field of Classification Search
CPC ..... E01H 5/061; E01H 10/007
See application file for complete search history.

*Primary Examiner* — Mathew Franklin Gordon
(74) *Attorney, Agent, or Firm* — David Kovacek; Maginot, Moore & Beck LLP

(57) ABSTRACT

An electrohydraulic system configured to operate a number of snow-removal components associated with a vehicle. The electrohydraulic system may comprise a controller, a number of actuators in electrical communication with the controller, a user interface in electrical communication with the controller, and a number of input regulators operable to regulate the control of the actuators.

20 Claims, 6 Drawing Sheets

ELECTROHYDRAULIC ACTUATOR SYSTEM FOR SNOW-REMOVAL COMPONENTS

TECHNICAL FIELD

This disclosure relates to a system for controlling snow-removal components associated with a vehicle. The system may comprise a number of actuators operable to physically maneuver and position the snow-removal components.

BACKGROUND

Snow removal vehicles require in-cab control of the components used to remove snow and ice from roads or other surfaces. In-cab controls may be implemented to provide a user with operational control of the components.

Conventional snow removal systems utilize hydraulic control controls, which may comprise considerable bulk within the cab of the vehicle, and experience hindered performance when operating multiple actuators simultaneously. Additionally, conventional hydraulic controls may experience suboptimal performance in extremely cold weather conditions, such as the type of conditions likely to be experienced by a snow-removal vehicle.

SUMMARY

One aspect of this disclosure is directed to a snow-removal system configured to be used by a vehicle. The system may comprise a controller in electrical communication with a number of actuators, a user interface and a number of input regulators. The actuators may be operable to control the functions of snow-removal components. The user interface may be operable to transmit command data suitable to indicate desired operations of the snow-removal components. The input regulators may be operable to enhance the operation or usability of the system for a user.

Another aspect of this disclosure is directed to a vehicle having snow-removal components, the vehicle further comprising a system configured to operate the snow-removal components. The system may comprise a controller in electrical communication with a number of actuators, a user interface and a number of input regulators. The actuators may he operable to control the functions of snow-removal components. The user interface may be operable to transmit command data suitable to indicate desired operations of the snow-removal components. The input regulators may be operable to enhance the operation or usability of the system for a user.

The above aspects of this disclosure and other aspects will be explained in greater detail below with reference to the attached drawings.

DETAILED DESCRIPTION

The illustrated embodiments are disclosed with reference to the drawings. However, it is to be understood that the disclosed embodiments are intended to be merely examples that may be embodied. in various and alternative forms. The figures are not necessarily to scale and some features may be exaggerated or minimized to show details of particular components. The specific structural and functional details disclosed are not to be interpreted as limiting, but as a representative basis kw teaching one skilled in the art how to practice the disclosed concepts.

Figure 1:
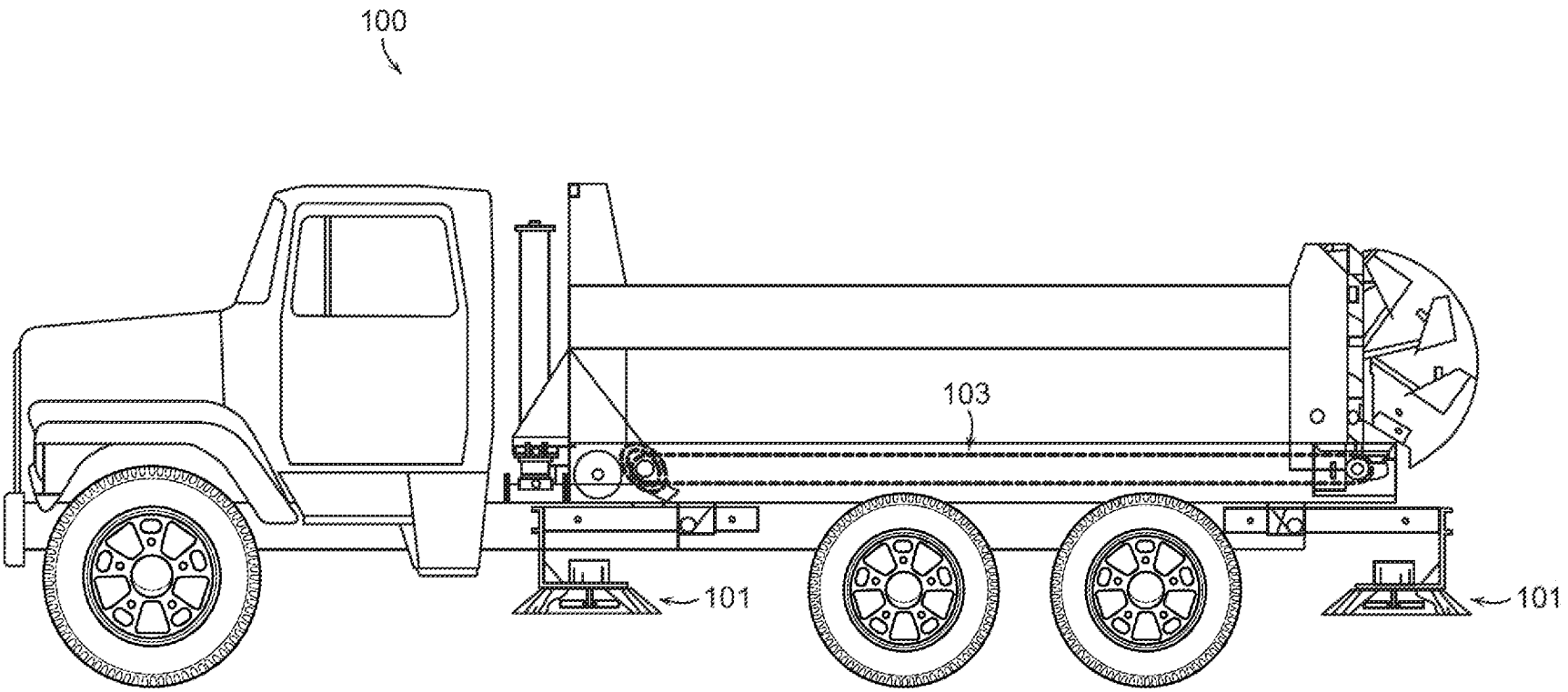
FIG. 1 is an illustration of a vehicle having a number of snow-removal components
Figure 2:
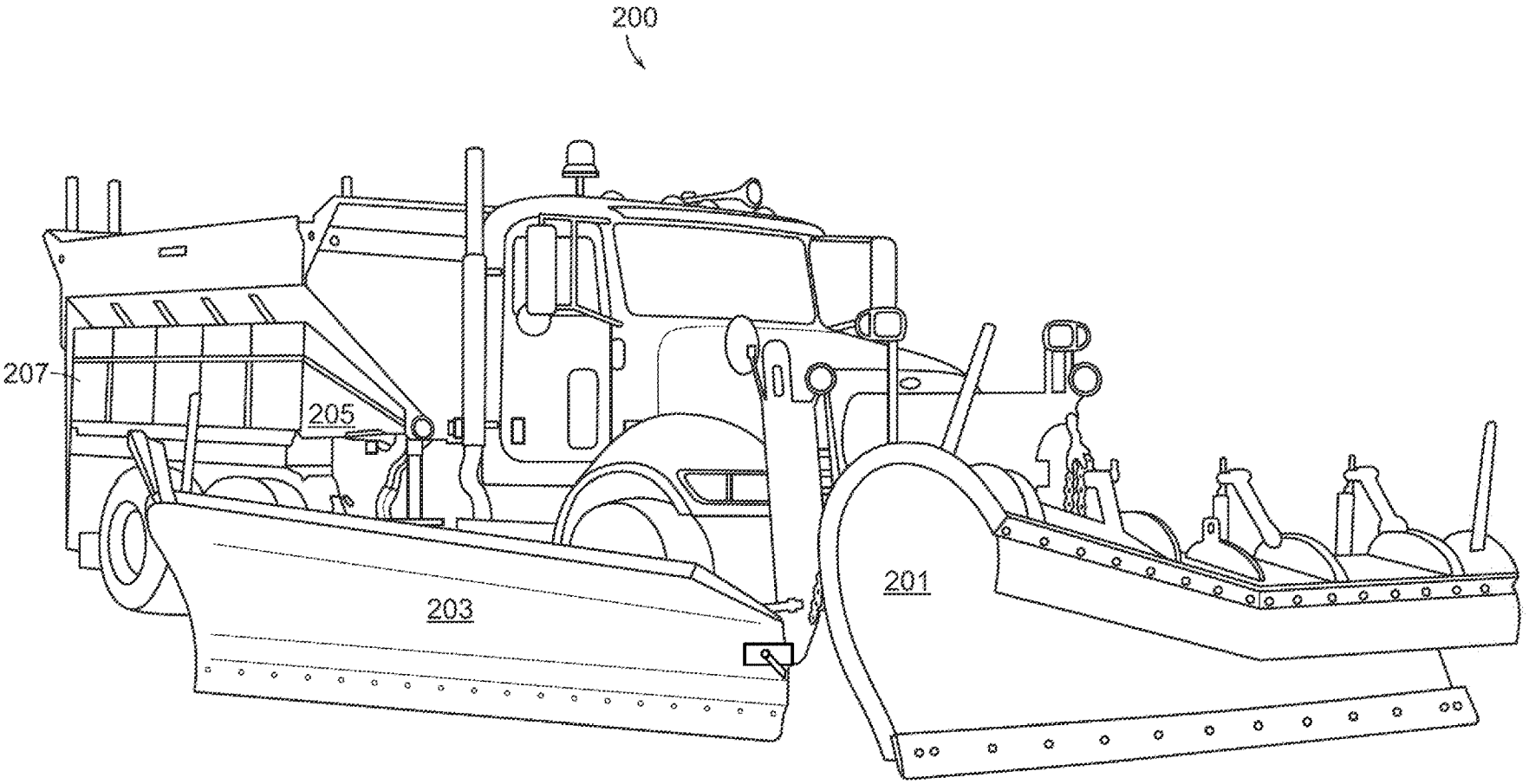
FIG. 2 is an illustration of a vehicle having number of snow-removal components.

Vehicles having mechanical components for performing tasks pertaining to the outside world may comprise many functions. In the embodiments depicted herein, the mechanical components may he directed to snow-removal, but other embodiments may comprise other configurations without deviating from the teachings disclosed herein. FIG. 1 provides an illustration of a vehicle 100 having a number of snow-removal components. In the depicted embodiment, vehicle 100 comprises spreaders 101 and a conveyor mechanism 103, but other embodiments may comprise other components. FIG. 2 provides an alternative embodiment, comprising a vehicle 200 having a first plow mechanism 201, a second plow mechanism 203, pre-wet liquid mechanism 205, and an anti-ice liquid mechanism 207. In the depicted embodiment, first plow mechanism 201 comprises a front plow and second plow mechanism 203 comprises a wing plow, but other embodiments may comprise other arrangements without deviating from the teachings disclosed herein. Some embodiments may have a different number of plows without deviating from the teachings disclosed herein, Each of vehicle 100 and vehicle 200 may advantageously comprise snow-removal component having moving or adjustable modes of operation, advantageously improving the versatility and utility of the vehicles during snow removal. For example, vehicle 100 may be operable to selectively activate spreaders 101 and conveyor mechanism 103 for the purpose of spreading de-icing material onto a street surface, while disengaging the components while driving over surfaces not requiring de-icing. Similarly, the effectiveness of vehicle 200 may advantageously be improved by permitting the adjustment of front plow 201 or wing plow 203, or by the controlled release of de-icing material from pre-wet liquid mechanism 205. Other embodiments may comprise other snow-removal components, such as a hopper, spreader, belly plow, tow plow, or other snow-removal component known to one of ordinary skill in the art without deviating from the teachings disclosed herein.

Adjustments to these components may advantageously benefit from implementation as an electrically-controlled hydraulic ("electro-hydraulic")) system, wherein actuators providing controlled motion to the components may comprise a hydraulic implementation controlled by an electrical data signal generated by a central controller. An electro-hydraulic system may advantageously permit multi-tasking operation with improved efficiency compared to a centralized hydraulic system, as each component utilizes a self-contained hydraulic subsystem. Control signals may be easily generated by a controller hardwired to an electric input of an electro-hydraulic actuator, providing a reliable control transmission that is relatively unaffected by temperature or environmental conditions compared to a hydraulic system. In addition, an electro-hydraulic implementation of the components may utilize hardwired electrical connections which arc advantageously less bulky and require less maintenance than a centralized hydraulic system. Such a system requires less space within an associated snow-removal vehicle, and requires less time and expenses pertaining to maintenance and repair of the transmission components of the system.

Figure 3:
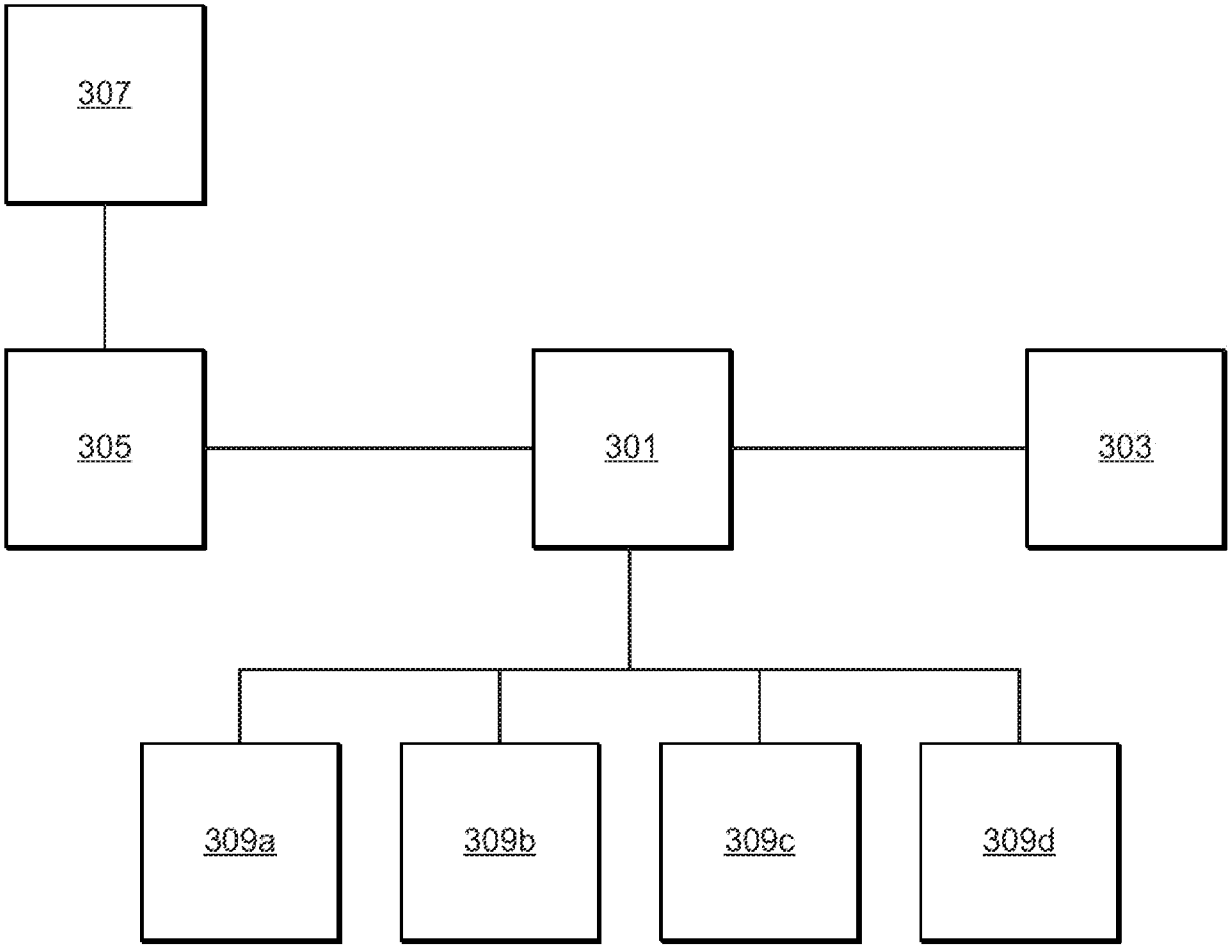
FIG. 3 is a diagrammatic illustration of a control system for a snow-removal component configured to be utilized by a vehicle.

FIG. 3 is a diagrammatic illustration of an electro-hydraulic control system according to one embodiment of the teachings herein. In the depicted embodiment, the system comprises a controller 301 in electrical communication with an actuator 303. Actuator 303 may comprise an electrohydraulic valve operable to receive data commands from controller 301 via the associated electrical communication channel. In the depicted embodiment actuator 303 may comprise an electrohydraulic valve, but other embodiments may comprise a hydraulic cylinder, a hydraulic motor, or any other embodiment known to one of ordinary skill in the art without deviating from the teachings disclosed herein. In the depicted embodiment, controller 301 is in electrical communication with a single actuator 303. but other embodiments may comprise additional actuators without deviating from the teachings disclosed herein. Controller 301 is configured to generate controller data operable to control the operation of actuator 303. Controller 301 may be operable to generate controller data in response to command data transmitted from a user interface 305. User interface 305 may be operable to generate command data in response to receiving user input via an input device 307.

Controller 301 may be operable to generate control data within a set of specified. operational limits to prevent actuator 303 from operating in a manner that may be dangerous, harmful to the system, or difficult to control. The specified operational limits of the control data may be specified by a number of regulators 309. Regulators 309 may be programmable, which may advantageously permit the system to be configurable for optimal operation within diverse environmental conditions, or with different configurations of an actuator 303. In some embodiments, regulators 309 may be programmable via a program access port, such as a universal serial bus (USB) port, controller area network (CAN) port, wireless access port, or any other configurations known to one of ordinary skill in the art without deviating from the teachings disclosed herein.

In the depicted embodiment, regulators 309 may comprise a dither regulator 309*a*, ramp regulator 309*b*, limit regulator 309*c*, and a park regulator 309*d*, but other embodiments may comprise different or additional regulators without deviating from the teachings disclosed herein.

A dither regulator 309*a* may be operable to filter command data to provide continuous low-level signal to actuator 303. Providing such a continuous low-level signal may provide smooth and reliable operation of an actuator, and may prevent stilted operation (so-called "stiction"). Dither signal may be adjustably determined by dither regulator 309*a* according to a specified signal suitable for a particular configuration of actuator 303. Embodiments comprised of multiple actuators 303 may utilize multiple dither regulators 309*a* to accommodate different actuator specifications, or a single dither regulator 309*a* may be operable to provide different dither signals to different command data associated with a particular actuator without deviating from the teachings disclosed herein.

A ramp regulator 309*b* may be operable to filter command data to operate an actuator 303 to provide a smooth motion for the associated moving component. The desired smooth motion may be achieved by limiting the acceleration the associated actuator may achieve during operation, thus limiting the acceleration of the associated moving component. Ramping may prevent a "jerky" motion, and improve the user's ability to reliably control the associated component. Ramping properties may be adjustably determined by ramp regulator 309*b* according to a specified behavior suitable for a particular configuration of actuator 303. Embodiments comprised of multiple actuators 303 may utilize multiple ramp regulators 309*b* to accommodate different actuator specifications, or a single ramp regulator 309*b* may be operable to provide different ramping filters to different command data associated with a particular actuator without deviating from the teachings disclosed herein.

A limit regulator 309*c* may be operable to filter command data to limit the speed of motion of a component associated with actuator 303. Limitations on the extremes of motion for a component may advantageously prevent actuator 303 from moving faster than the safe capabilities of the component. Limiting the range of motion may advantageously prevent damage to actuator 303 or the associated component. Limiting the range of motion may advantageously improve the safety of the system with respect to a user or other persons in vicinity of the system during operation, and may improve the user's ability to reliably control the associated component. Limitations of the range of motion may comprise a minimum speed, a maximum speed, or both without deviating from the teachings disclosed herein. Speed limitations may be adjustably determined by limit regulator 309*c* according to a specified behavior suitable for a particular configuration of actuator 303. Embodiments comprised of multiple actuators 303 may utilize multiple limit regulators 309*c* to accommodate different actuator specifications, or a single limit regulator 309*c* may be operable to provide different ramping filters to different command da associated with particular actuator without deviating from teachings disclosed herein.

A park regulator 309*d* may be operable to filter command data for the purpose of operating actuator 303 to achieve a particular predetermined configuration of the system. In the depicted embodiment, park regulator 309*d* may be operable to supersede controller data generated by controller 301 and instead operate actuator 303 such that the associated component is positioned into a programmed configuration, irrespective of other user input. In the depicted embodiment, the programmed configuration of park regulator 309*d* may he adjusted by the user, but other embodiments may comprise other configurations without deviating from the teachings disclosed herein. The programmed configuration may be utilized to improve safety of the associated components when the components are not in use. By way of example and not limitation, a front plow component may have a park configuration with the plow elevated off the ground to prevent damage to the front plow and damage to the road when driving. Other components may comprise other park configurations without deviating from the teachings disclosed herein. In some embodiments, park regulator 309*d* may comprise an interlock mechanism (also called a "dead man's switch") operable to prevent all other operation of the associated actuator while active. The interlock mechanism may be configured to prevent operation of the actuator in the parked position or an arbitrary position without deviating from the teachings disclosed herein. Some components may have multiple park configurations to address different contexts without deviating from the teachings disclosed herein. Embodiments comprised of multiple actuators 303 may utilize multiple park regulators 309*d* to accommodate different actuator specifications, or a single park regulator 309*d* may be operable to provide different ramping filters to different command data associated with a particular actuator without deviating from the teachings disclosed herein.

Figure 4:
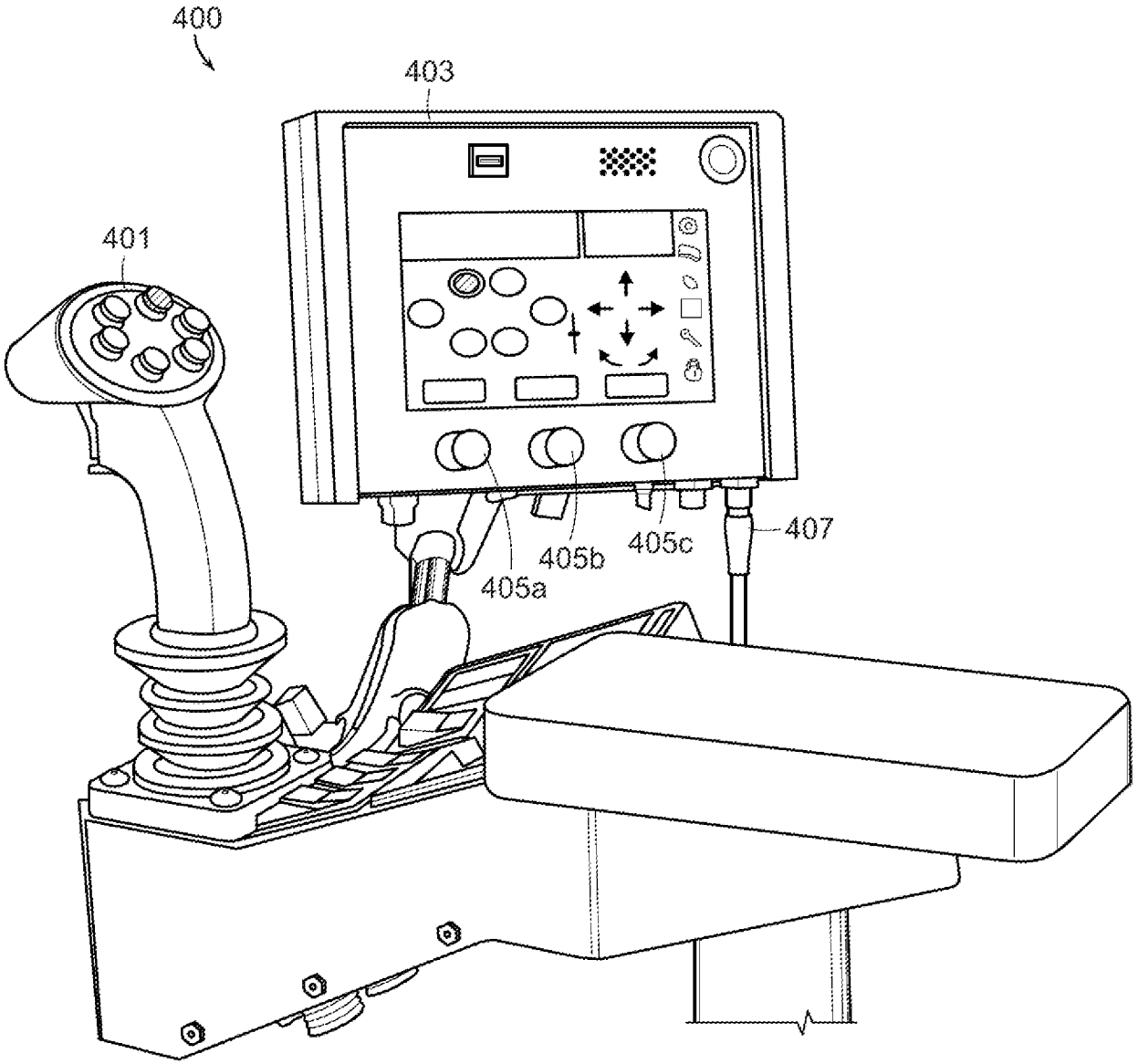
FIG. 4 is illustration of a first user interface of a snow-removal system.

FIG. 4 is an illustration of one embodiment of a user interface 400 for a system, such as the system of FIG. 3. Interface 400 may comprise an input device 401, a display 403 and display controls 405. A user may operate the system by utilizing input device 401 or display controls 405 to generate command data. The user may receive visual interface feedback, or additional feedback via display 403. In the depicted embodiment, input device 401 comprises a joystick configuration, but other embodiments may comprise other configurations without deviating from the teachings disclosed herein. Some embodiments may comprise multiple joysticks without deviating from the teachings disclosed herein.

In the depicted embodiment, user interface 400 may be in electrical data communication with the rest of the system (not shown) via an electrical connection 407. In the depicted embodiment, electrical connection 407 comprises a coaxial cable, but other embodiments may comprise other configurations without deviating from the teachings disclosed herein. Some embodiments may comprise a wireless electrical connection without deviating from the teachings disclosed herein. Some embodiments may utilize a controller area network (CAN) bus to electrically connect a user interface to one or more controllers without deviating from the teachings disclosed herein.

Figure 5:
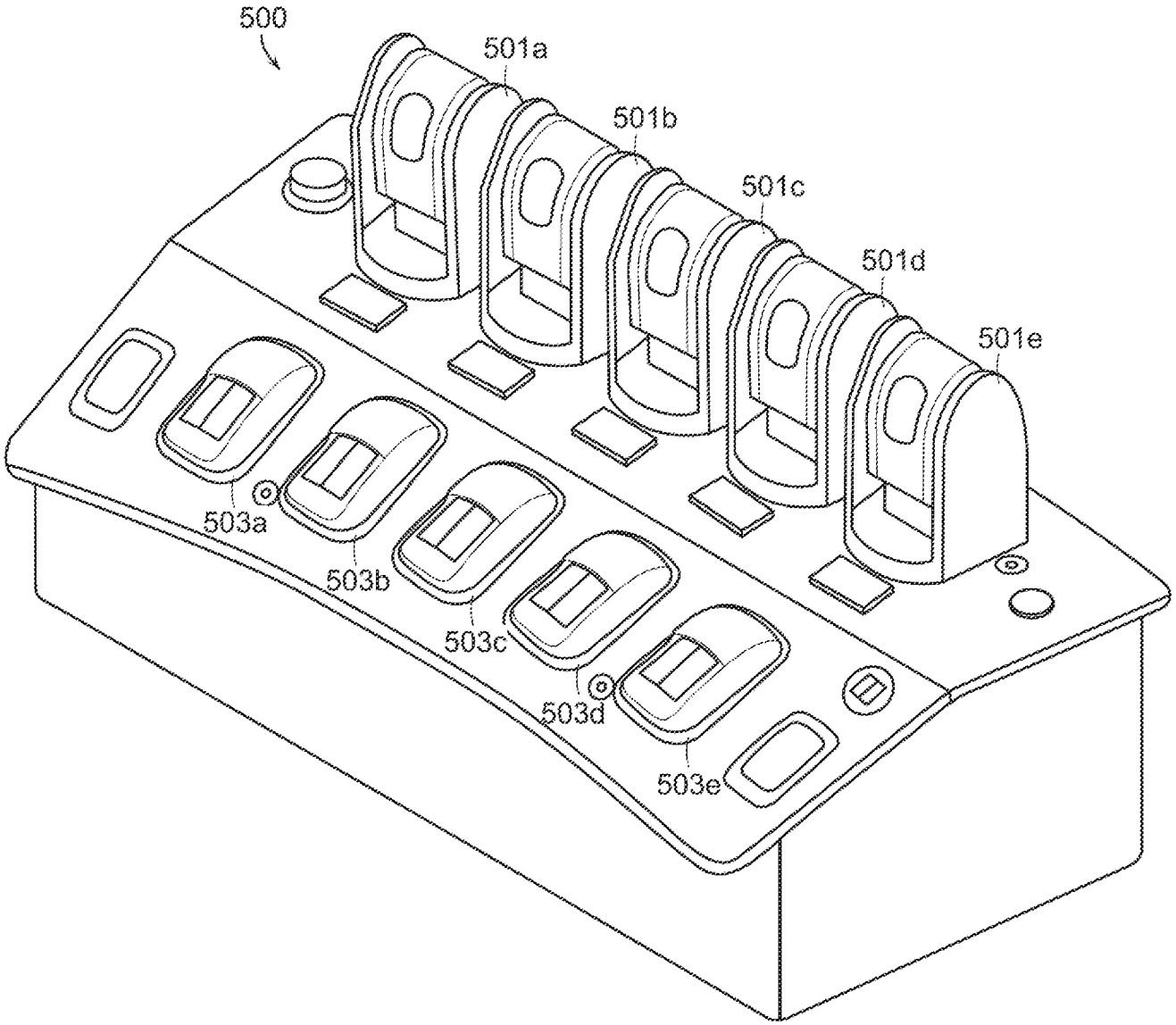
FIG. 5 is an illustration of a second user interface of a snow-removal system.

Other embodiments may comprise other forms of user interfaces having other configurations. FIG. 5 is an illustration of another embodiment of a user interface 500, comprising a number of axis paddles 501 and switches 503, User interface 500 may advantageously provide a user with direct-access to control a plurality of system components simultaneously. The depicted embodiment does not comprise a display, but other embodiments may comprise a display such as display 403 (see FIG. 4) without deviating from the teachings disclosed herein.

Figure 6:
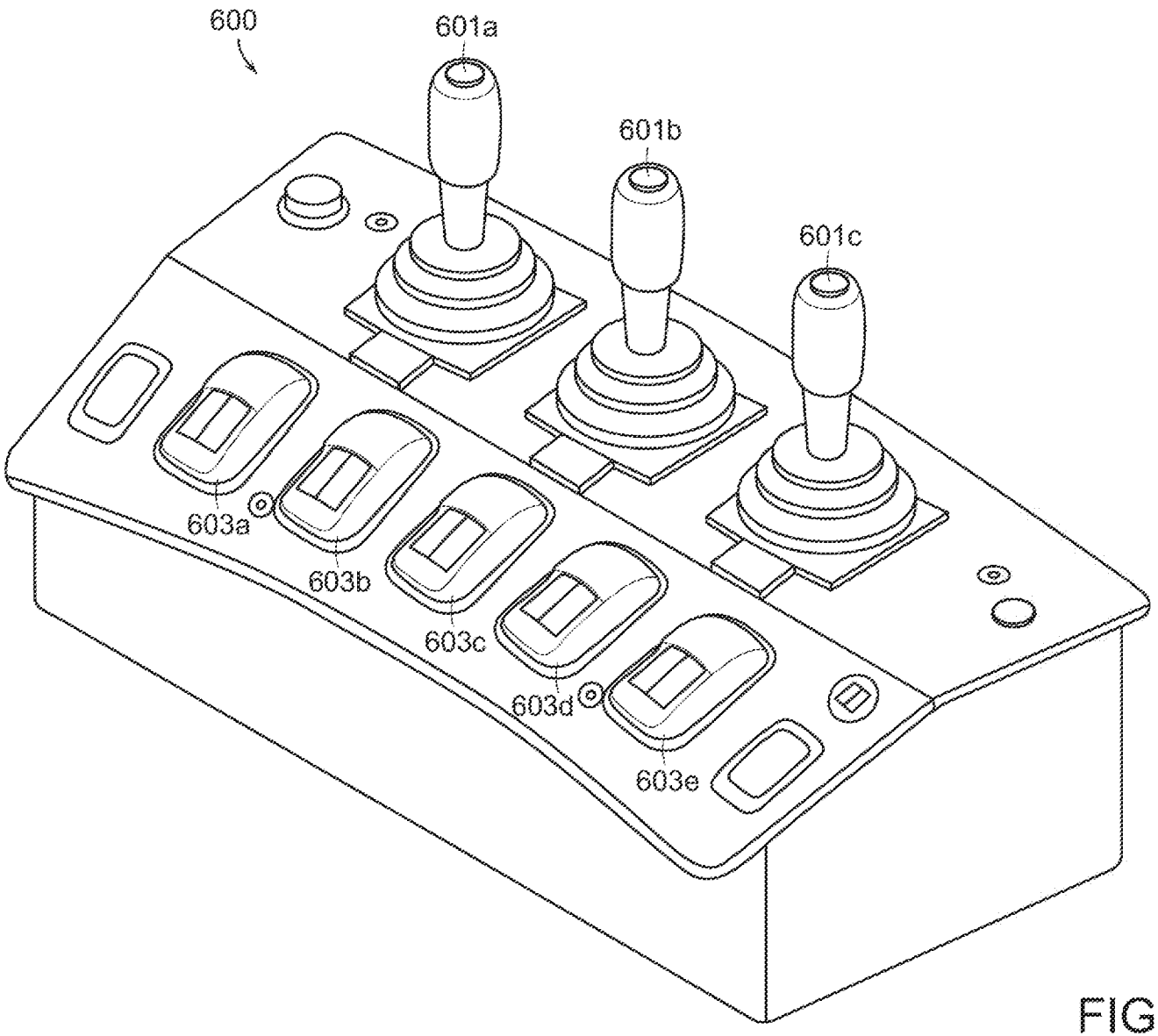
FIG. 6 is an illustration of a third user interface of a snow-removal system.

FIG. 6 is an illustration of another embodiment of a user interface 600, comprising a number of joysticks 601 and switches 603. User interface 600 may advantageously provide a user with direct-access to control a plurality of system components simultaneously. The depicted embodiment does not comprise a display, but other embodiments may comprise a display such as display 403 (see FIG. 4) without deviating from the teachings disclosed herein.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A snow-removal system configured to be coupled to a vehicle, the system comprising:

a controller;

a number of actuators configured to be in electrical data communication with the controller, each of the number of actuators operable to be responsive to controller data generated by the controller;

a user interface configured to be in electrical data communication with the controller, the user interface operable to transmit command data to the controller in response to user input, the controller being operable to generate controller data in response to receiving the command data; and a number of input regulators in data communication with the controller each of the number of input regulators configured to filter the controller data to conform with specified operational limits of each of the number of actuators, and wherein each of the number of actuators comprises an electrically-controlled hydraulic actuator.

2. The system of claim 1, wherein the electrical data communication between the controller and each of the number of actuators comprises a hardwire electrical connection.

3. The system of claim 1, wherein the number of input regulators comprises a dither. regulator operable to apply a dither signal to the controller data.

4. The system of claim 1, wherein the number of input regulators comprises a ramp regulator operable to limit an acceleration of an associated actuator.

5. The system of claim 1, wherein the number of input regulators comprises a limit regulator operable to impose a maximum speed limit or a minimum speed limit on the controller data.

6. The system of claim 5, wherein the limit regulator is operable to impose a maximum speed limit and a minimum speed limit on the controller data.

7. The system of claim 1, wherein the number of input regulators comprises a park regulator operable to generate controller data corresponding to a predetermined configuration of an associated actuator irrespective of associated user input.

8. The system of claim 1, wherein at least one of the number of input regulators comprises a programmable regulator.

9. The system of claim 1, further comprising an interlock, wherein the controller is configured to generate controller data only when the interlock is active.

10. The system of claim 1, wherein the user interface comprises a joystick.

11. The system of claim 1, wherein the user interface comprises an axis paddle.

12. The system of claim 1, wherein the user interface comprises a display.

13. The system of claim 1, wherein the number of actuators are further configured to control an operation of at least one of a plow mechanism, a spreader mechanism, a conveyor mechanism, an anti-ice liquid mechanism, or a pre-wet liquid mechanism.

14. The system of claim 13, wherein the number of actuators are further configured to control an operation of a plow mechanism, a spreader mechanism, conveyor mechanism, an anti-ice liquid mechanism, and a pre-wet liquid mechanism.

15. A vehicle having snow-removal components, the vehicle further having a system comprising:

a controller;

a number of actuators configured to be in electrical data communication with the controller, each of the number of actuators operable to control an operation of an associated snow-removal component and operable to be responsive to controller data generated by the controller;

a user interface configured to be in electrical data communication with the controller, the user interface operable to transmit command data to the controller in response to user input, the controller being operable to generate controller data in response to receiving the command data; and a number of input regulators in data communication with the controller, each of the number of input regulators configured to filter the controller data to conform with specified operational limits of each of the number of actuators, and wherein each of the number of actuators comprises an electrically-controlled hydraulic actuator, wherein the user interface is disposed at least in part within the body of the vehicle.

16. The system of claim 15, wherein a snow-removal component associated with at least one of a plow mechanism, a spreader mechanism. a conveyor mechanism, an anti-ice liquid mechanism, or a pre-wet liquid mechanism.

17. The system of claim 15, wherein the electrical data communication between the controller and each of the number of actuators comprises a hardwire electrical connection.

18. The system of claim 15, wherein the number of input regulators comprises a dither regulator operable to apply a dither signal to the controller data.

19. The system of claim 15, wherein the number of input regulators comprises a ramp regulator operable to limit the rate of change of the position of the associated snow-removal component.

20. The system of claim 15, wherein the number of input regulators comprises a limit regulator operable to impose a maximum limit and a minimum limit on the controller data.

* * * * *